US006955124B2

(12) United States Patent
Ciaramitaro et al.

(10) Patent No.: US 6,955,124 B2
(45) Date of Patent: Oct. 18, 2005

(54) SCREEN PRINTED FABRIC

(75) Inventors: Fred Ciaramitaro, Eastpointe, MI (US); James Roger Johnson, Jr., Lapeer, MI (US)

(73) Assignee: Stahls' Inc., St. Clair Shores, MI (US)

( * ) Notice: Subject to any disclaimer, the term of this patent is extended or adjusted under 35 U.S.C. 154(b) by 0 days.

(21) Appl. No.: 10/748,724

(22) Filed: Dec. 30, 2003

(65) Prior Publication Data

US 2004/0154480 A1 Aug. 12, 2004

Related U.S. Application Data

(62) Division of application No. 10/075,631, filed on Feb. 14, 2002, now Pat. No. 6,752,075.

(51) Int. Cl.[7] ..... B41F 1/34
(52) U.S. Cl. ..... 101/485; 101/34
(58) Field of Search ..... 101/33, 34, 35, 101/485, 494, 483, 150, 151, 170; 2/275; 156/72, 241, 248, 291

(56) References Cited

U.S. PATENT DOCUMENTS 4,588,629 A 5/1986 Taylor
4,840,696 A * 6/1989 Krasuski et al. ..... 156/353
5,422,173 A 6/1995 Stahl
5,635,001 A 6/1997 Mahn, Jr.
5,914,176 A 6/1999 Myers
5,990,440 A 11/1999 Yamaguchi et al.
6,455,752 B1 * 9/2002 Vesey ..... 602/41

FOREIGN PATENT DOCUMENTS

DE 298 21 891 U1 4/1999

* cited by examiner

*Primary Examiner*—Ren Yan
(74) *Attorney, Agent, or Firm*—Rader, Fishman & Graue PLLC

(57) ABSTRACT

The present invention involves a single layered printed fabric for applying a printed fabric pattern to an object. The printed fabric has a predetermined shape corresponding to the printed fabric pattern. The printed fabric includes first and second portions disposed adjacent each other, a third portion, and a fourth portion. The third portion is printed on the first and second portions, wherein the third portion represents a simulated stitch attaching the first portion to the second portion. The fourth portion is printed on the first portion, wherein the fourth portion represents a simulated stitch hole to simulate an appearance of a hole through which the stitch disposes to simulate an appearance that the first portion is a top layer stitched onto the second portion which is a bottom layer.

7 Claims, 2 Drawing Sheets

SCREEN PRINTED FABRIC

This is a divisional application of U.S. patent application Ser. No. 10/075,631 filed on Feb. 14, 2002, now U.S. Pat. No. 6,752,075.

BACKGROUND OF THE INVENTION

1. Field of the Invention

The present invention is related to a printed fabric for applying a printed fabric pattern to an object and a method for making the printed fabric.

2. Background Art

The art of applying a printed fabric or an applique onto an object, such as a garment, has been done and continues to be improved. There are several ways known in the art of manufacturing and applying an applique to a garment. However, the industry has shown a need to provide a more cost and time effective applique and a way of making the applique without sacrificing the aesthetic value or materials thereof.

For example, an applique may be a laminate having a top layer and a bottom layer attached onto each other. The bottom layer may have an adhesive which may be applied onto a garment with heat or pressure. When applied onto the garment, the applique provides an appearance of stitching or embroidery of the applique onto the garment. In many situations, the cost and time effectiveness of attaching the layers together may be improved.

Some appliques are single layered having printed designs thereon. Such appliques are directly applied onto a garment, but in most situations do not provide an industry acceptable appearance of a laminate embroidered onto the garment.

The industry has also shown a need to improve ways of making printed fabrics, e.g. screen printed twills, which are to be applied onto garments. Currently, manufacturers of such printed fabrics are challenged due to mis-accounted shrinkage of the printed fabrics during a typical step of drying. In many situations, manufacturers must account for shrinkage of a printed fabric when the printed fabric is dried. Giving the various parameters such as temperature, time, materials, shrinkage calculations are not always exact. In many situations, this results in cutting dried printed fabric slightly in error. In turn, such fabrics are discarded, thereby increasing costs and production time.

SUMMARY OF THE INVENTION

Thus, it is an object of the present invention to provide a more cost and time effective way of making an applique without sacrificing the aesthetic appearance of stitching or embroidery of the applique onto a garment.

It is another object of the present invention to provide an applique which is single layered and provides an appearance of stitching of a plurality of fabric layers.

It is another object of the present invention to provide a single layered printed fabric for applying a printed fabric pattern to an object. The printed fabric has a predetermined shape corresponding to the printed fabric pattern. The printed fabric comprises first and second portions disposed adjacent each other. The printed fabric further comprises a third portion printed on the first and second portions, wherein the third portion represents a simulated stitch attaching the first portion to the second portion. The fabric further comprises a fourth portion printed on the first portion, wherein the fourth portion represents a simulated stitch hole to simulate an appearance of a hole through which the stitch disposes to simulate an appearance that the first portion is a top layer stitched onto the second portion which is a bottom layer.

It is yet another object of the present invention to provide a method of making an applique for applying a printed fabric pattern to an object. The method comprises providing an unprinted substrate for printing a design thereon, and cutting the unprinted substrate to form a predetermined shape corresponding to the fabric pattern and to form a registration hole on the substrate. The method further comprises printing the fabric pattern on the unprinted substrate having the predetermined shape to define a printed substrate having the printed fabric pattern, and drying the printed substrate at a predetermined temperature and time period.

DETAILED DESCRIPTION OF THE PREFERRED EMBODIMENTS

The present invention provides a single layered printed fabric having a plurality of portions printed thereon which simulate an appearance of multiple layers of fabric stitched or sewn together. The present invention includes a single layered fabric having a plurality of portions printed thereon which create the appearance of at least one fabric layer sewn or stitched onto another fabric layer without sacrificing aesthetic accuracy under industry standards. Thus, the present invention maintains an appearance of stitching without requiring multiple fabric layers. The present invention only includes a single layered printed fabric.

Figure 1:
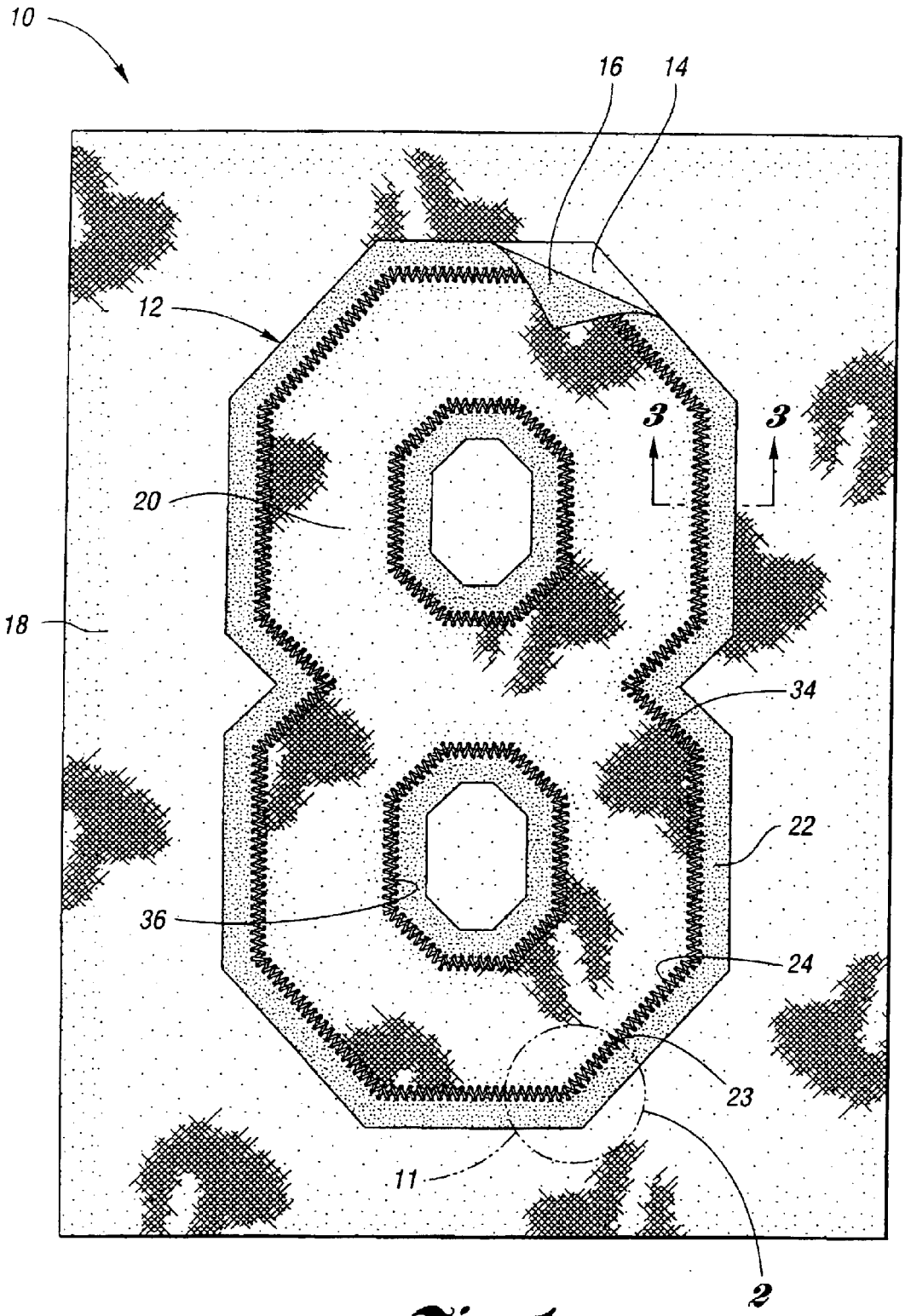
FIG. 1 is a top view of a printed laminate in accordance with the present invention.

FIG. 1 illustrates a printed laminate 10 including printed fabric 12, release paper 14, and adhesive 16 disposed between printed fabric 12 and release paper 14. FIG. 1 shows printed laminate 10 for applying a printed fabric pattern to an object. The printed fabric pattern may be any suitable design desired by a user. In this example, the printed fabric pattern represents the numeral eight. Printed fabric 12 is a single layer fabric having a predetermined shape corresponding to the printed fabric pattern. Printed fabric 12 includes a plurality of portions printed thereon representing different shapes and pigments. Printed fabric 12 includes first and second portions 20, 22. First and second portions 20, 22 are adjacent each other. Printed fabric 12 further includes third portion 23 printed on both first and second portions 20, 22. Third portion 23 represents a simulated stitch appearing to attach first portion 20 to second portion 22. As shown, fourth portion is printed on first portion 20. Fourth portion 24 represents a simulated stitch hole to simulate an appearance of a hole through which the simulated stitch disposes. In turn, this simulates an appearance that first portion 20 is a top fabric layer stitched onto a bottom fabric layer which is represented by second portion 22.

Figure 2:
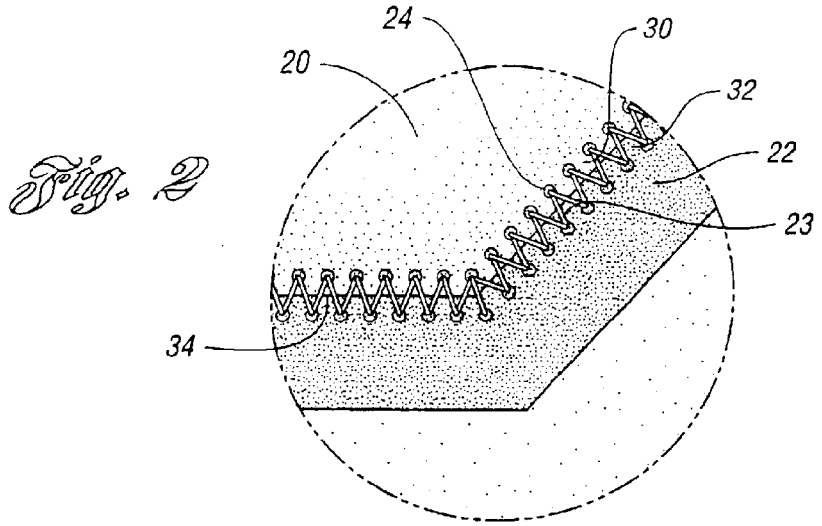
FIG. 2 is an enlarged view of the printed laminate in circle 11 of FIG. 1.

As shown in FIGS. 1 and 2, first portion 20 has upper stitch portion 30 and second portion 22 has lower stitch portion 32 adjacent upper stitch portion 30. As shown, third portion 23 is printed on upper and lower stitch portions 30, 32 to simulate the appearance of stitching. First portion 20 has an outer periphery 34 which defines the outer shape of first portion 20. As shown, upper stitch portion 30 is adjacent outer periphery 34. First portion 20 includes an inner periphery 36 which defines an inner shape of first portion 20. Upper stitch portion 30 is also adjacent inner periphery 36, as shown.

Figure 3:
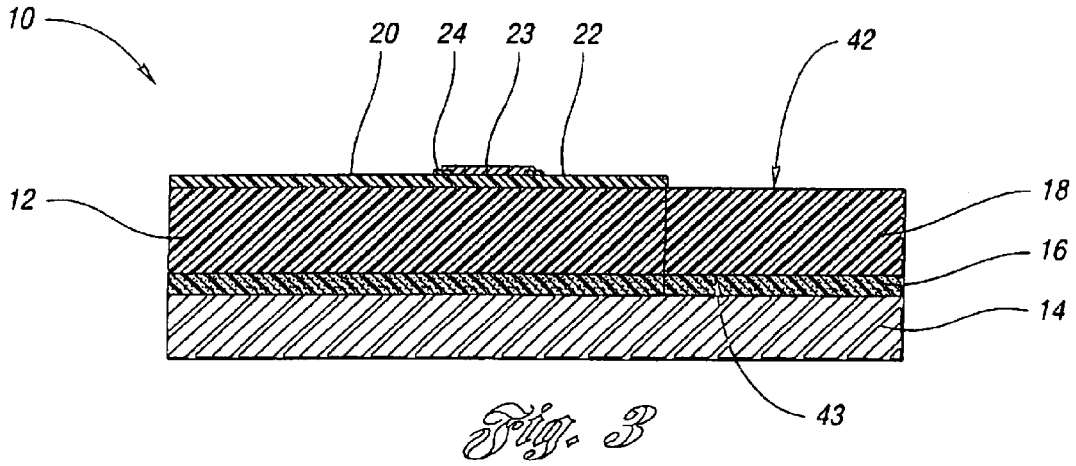
FIG. 3 is a cross-sectional view of the printed laminate of FIG. 1 taken along lines 3—3.

As depicted in FIGS. 1–3, third portion 23 represents a simulated plurality of stitches to simulate an appearance of stitching a top fabric layer to a bottom fabric layer, represented by first portion 20 and second portion 22, respectively. Fourth portion 24 represents a simulated plurality of stitch holes which, in turn, simulate an appearance of holes through which the simulated stitches are disposed. As shown in FIG. 3, printed laminate 10 has top and bottom sides 42, 43, wherein bottom side 43 has adhesive 16 disposed thereon to apply the printed fabric on the object. Printed fabric 12 may be made of any suitable material. For example, printed fabric 12 may be made of twill. Release paper 14 may be made of any suitable material, such as Mylar™. The adhesive 16 may be any suitable adhesive known in the art. For example, adhesive 16 may be a heat-sensitive adhesive or a pressure-sensitive adhesive known in the art.

First portion 20 may be any desired shape and/or pigment. Second portion 22 may also be any desired shape and/or pigment. For example, First portion 20 may simply be a desired color printed on the area defined by outer periphery 34 and inner periphery 36. In this embodiment, First portion 20 takes on a numeral eight as shown. Then, second portion 22 may include a different pigment and/or shape. In this embodiment, second portion 22 outlines the numeral eight of first portion 20. The contrast in colors and shapes between the first and second portions outline the predetermined shape corresponding to the printed fabric pattern and provide a simulated appearance of multiple fabric layers positioned on top of each other.

Third portion 23 provides a simulated stitch look by having a pigment different than the pigment of either first portion 20 or second portion 22. However, third portion 23 may have a shade of either first portion 20 or second portion 22. Fourth portion 24 provides a simulated appearance of stitch holes through which the simulated stitches are disposed. In this embodiment, this is accomplished by the fourth portion 24 having a shade of second portion 22. This creates an appearance that stitch holes are formed through first portion 20, the top layer, and that a shade of second portion 22, the bottom layer, can be seen therethrough. This appearance is often viewed when a top layer of fabric is actually stitched onto a bottom layer of fabric. The color of third portion 23 should be different than the color of any of the other colors since it is desired to highlight a pattern of stitches to simulate stitching of a top layer onto a bottom layer. The color of the fourth portion 24 should take on a shade of what would appear to be the bottom layer seen through a hole. In this example, the bottom layer is second portion 22 which is adjacent outer periphery 34 and inner periphery 36.

However, other embodiments may include the reverse of what is shown in the figures which would not fall beyond the scope or spirit of the present invention. For example, in another embodiment (not shown), the top layer may take on the area represented by second portion 22 and the bottom layer may take on the area represented by first portion 20. In this example, the color of fourth portion 24 should be a shade of first portion 20 to represent stitch holes through which such colors would be viewed.

Figure 4:
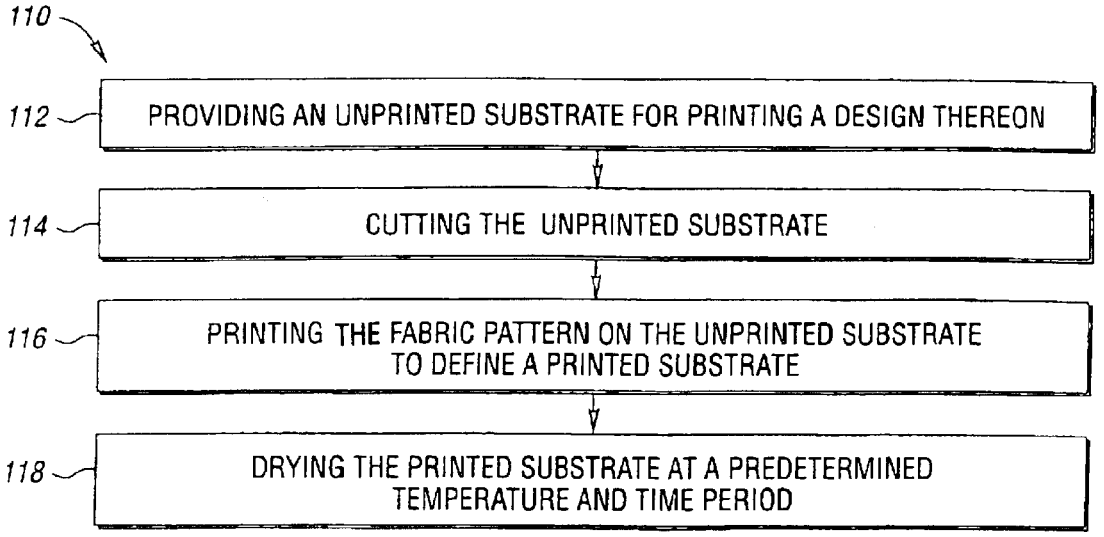
FIG. 4 is a flowchart depicting one method of making the printed laminate in accordance with the present invention.

FIG. 4 illustrates one method 110 of making a printed fabric 12 for applying the printed fabric pattern to an object. As shown, method 110 comprises providing an unprinted laminate or substrate for printing a design thereon shown in block 112. The substrate is a laminate having a fabric layer for printing the fabric pattern thereon, a release layer and an adhesive layer disposed between the fabric layer and the release layer, as described above. Next, method 110 includes cutting the unprinted substrate to form a predetermined shape corresponding to the fabric pattern and to form a registration hole on the substrate as shown in block 114. In this embodiment, the step of cutting includes "kiss-cutting" the laminate to cut only the fabric layer and the adhesive layer of the laminate. In this embodiment, the release layer is not cut. Also, the step of cutting may include cutting the substrate to form a plurality of registration holes on the substrate.

Method 110 further includes printing the fabric pattern on the predetermined shape of the unprinted substrate to define a printed substrate having the printed fabric pattern thereon in block 116. This step may include several printing steps based on the desired pattern on the printed fabric. In the embodiment shown in FIG. 1, printed laminate 10 provides an appearance of two fabric layers placed on top of each other, simulating the layers being stitched together. Thus, in this embodiment, the steps of printing include printing a first portion on the fabric layer to form a simulated top layer, wherein the first portion has an upper stitch portion. Next, the method includes printing a second portion adjacent the first portion on the fabric layer to form a simulated bottom layer, wherein the second portion has a lower stitch portion adjacent the upper stitch portion. The method further includes printing a third portion on the upper and lower stitch portion to form simulated stitches having an appearance of attaching the top layer to the bottom layer. The method further includes printing a fourth portion on the upper stitch portion to simulate stitch holes for an appearance of holes through which the simulated stitches are disposed. This provides an appearance of the top layer being stitched to the bottom layer.

It is to be noted that first portion 20 or any other portions 22,23,24 for that matter may take on the pigment of the fabric. In such event, the step of printing the respective portion would not be necessary and, thus, would not be performed. The remaining portions would be printed to outline the respective portion.

As depicted in block 118 in FIG. 4, the method further comprises drying the printed substrate at a predetermined temperature and time period. In this embodiment, the predetermined temperature is between about 400° to 450° F. and the time period is about 10–20 seconds. The predetermined temperature and time period may be varied to temperatures and time periods. These parameters typically, but not necessarily, shrink the printed substrate during drying.

The method as described above and shown in FIG. 4 solves the problem of mis-calculated or mis-accounted shrinking of the substrate which, in turn, typically would result in misaligned cutting. The method allows the substrate to shrink after cutting is complete. It has been found that by cutting the unprinted substrate before printing avoids cutting miscalculations, thereby saving time and materials.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. The method of making a single layered applique having the appearance of multiple layers stitched together comprising the steps of:

printing a first portion on a fabric layer to form a simulated top layer, the first portion having an upper stitch portion;

printing a second portion on the fabric layer adjacent the first portion to form a simulated bottom layer, the second portion having a lower stitch portion adjacent the upper stitch portion;

printing a third portion on the upper and lower stitch portions to form a simulated stitch attaching the top layer to the bottom layer; and printing a fourth portion on the upper stitch portion to simulate a stitch hole through which the stitch is disposed to, simulate an appearance of the top layer being stitched to the bottom layer.

2. The method of making a single layered applique having the appearance of multiple layers stitched together, comprising the steps of:

providing a substrate for printing a design on;

cutting the substrate to form a predetermined shape;

providing first and second portions adjacent to each other on said substrate;

printing a third portion on the first and second portions with such third portion representing a simulated stitch attaching the first and second portions together;

printing a fourth portion on the first portion to represent a simulated stitch hole through which the simulated stitch of the third portion extends to simulate the appearance that the first portion is a top layer stitched onto the second portion which is a bottom layer; and drying the printed substrate at a predetermined temperature and period.

3. The method of claim 2 wherein the substrate is a laminate having a fabric layer for printing the fabric pattern thereon, a release layer, and an adhesive layer disposed between the fabric layer and the release layer.

4. The method of claim 2 wherein the step of cutting includes kiss-cutting the laminate to cut only the fabric layer and the adhesive layer of the laminate.

5. The method of claim 4 wherein the step of cutting includes cutting the substrate to form a plurality of registration holes on the substrate.

6. The method of claim 2 wherein the predetermined temperature is between about 400 to 450 degrees Fahrenheit and the time period is about 10–25 seconds.

7. The method of claim 2 wherein the predetermined temperature and time period is a temperature and time period which shrinks the printed substrate.

* * * * *